United States Patent [19]

Marchesi

[11] Patent Number: 4,469,039

[45] Date of Patent: Sep. 4, 1984

[54] WORK FEED DEVICE IN SEWING MACHINES

[75] Inventor: Franco Marchesi, Pavia, Italy

[73] Assignee: Rockwell-Rimoldi S.p.A., Italy

[21] Appl. No.: 537,767

[22] Filed: Sep. 30, 1983

[30] Foreign Application Priority Data

Apr. 20, 1983 [IT] Italy ..... 20689 A/83

[51] Int. Cl.[3] ..... D05B 27/02

[52] U.S. Cl. ..... 112/323; 112/313

[58] Field of Search ..... 112/323, 313, 314

[56] References Cited

U.S. PATENT DOCUMENTS

| | | | |
|---|---|---|---|
| 3,611,817 | 10/1971 | Smith | 112/313 |
| 4,027,609 | 6/1977 | Kerr | 112/313 |
| 4,159,004 | 6/1979 | Ross | 112/323 X |
| 4,295,434 | 10/1981 | Hsiao | 112/323 X |

*Primary Examiner*—Werner H. Schroeder

*Assistant Examiner*—A. Falik

[57] ABSTRACT

A work feed device for sewing machines, which comprises feed dog carrier bars performing an elliptical movement with the aid of two mechanisms; namely, an advancing mechanism and a raising mechanism. The advancing mechanism is composed of an oscillating shaft provided with arms, which in turn are connected to the feed dog support bars at the opposite end to that where the dogs are mounted. The raising mechanism comprises a support making a vertical reciprocating movement and which is provided with a horizontal guide along which the feed dog support bars are moved reciprocatingly by the advancing mechanism. Finally, vertical movement of the support comprises two connecting rods approximately parallel to one another. They are pivoted at one end to the said support and at the other end to a part connected to the frame of the sewing machine.

6 Claims, 1 Drawing Figure

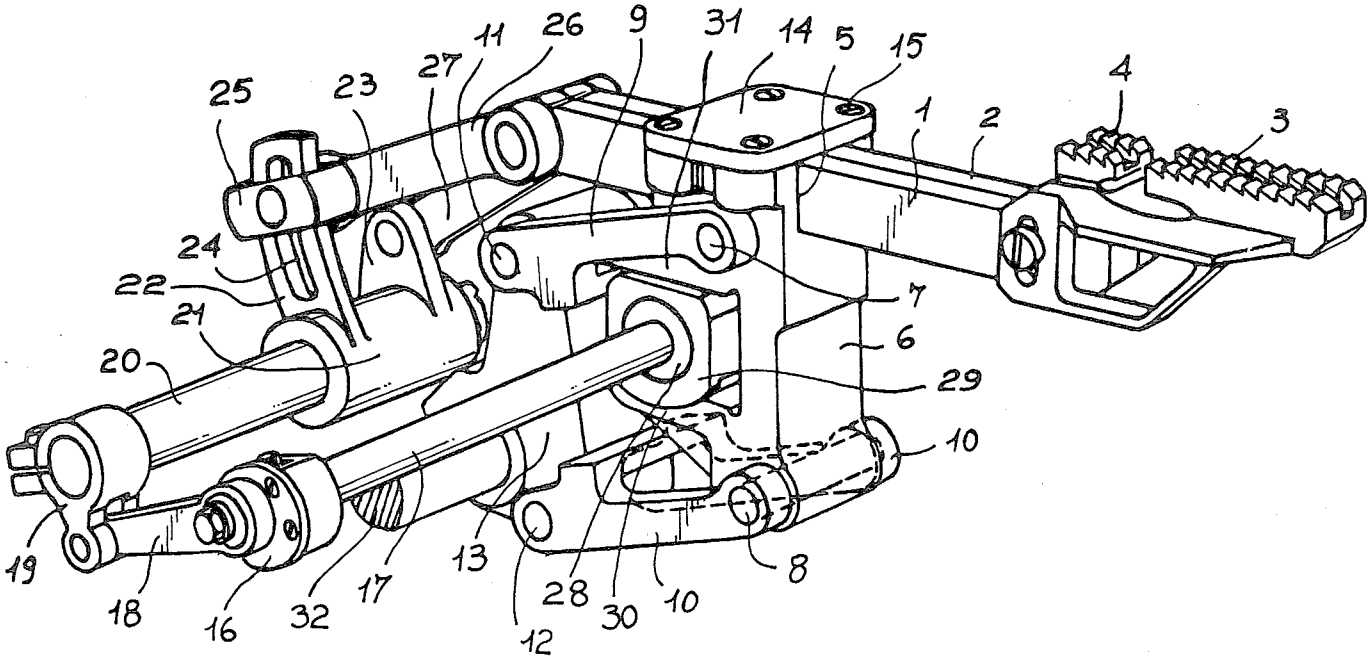
3
4
2
1
15
5
14
31
9
26
11
27
23
25
24
22
21
20
19
18
16
32
17
13
12
28
30
10
8
10
29
6
7

WORK FEED DEVICE IN SEWING MACHINES

BACKGROUND OF THE INVENTION

The present invention relates to an improved work feed device for sewing machines, comprising feed dogs, the main feed dog and the differential feed dog, wherein the path of movement of the feed dog or dogs is elliptical.

Feed devices having an elliptical trajectory are already known, but these have the defect that the trajectory has its major axis inclined relative to the work plane of the machine, with the consequence that the dog or dogs acts or act on the foot with a thrust such that maintenance of its contact with the work is not ensured and incorrect feed of the work may ensue.

The solution which entails this disadvantage is described, for example, in Italian patent No. 544,068. In addition, in known feed devices, the moving parts are subject to considerable wear, dismantling is difficult, and consequently, it is not easy to replace parts. These disadvantages arise not only in the case of the patent referred to above, but also in the case of U.S. Pat. No. 2,442,647.

SUMMARY OF THE INVENTION

An object of the present invention is the elimination of the disadvantages described, through the provision of a feed device in which the raising of the dog is separated from its advance movement. This is achieved with the device according to the present invention in which the heavier kinematic system, which serves the purpose of supporting the feed dog support bars and which brings about the veritcal raising of the feed dogs, is moved reciprocatingly over a very short path, while the lighter kinematic system, whose function is to advance the work, is moved reciprocatingly over relatively long paths.

In addition, in the present invention, the alignment of the feed dog with the work plane is facilitated because it is simple to adjust the orientation of the ellipse over which the feed dog travels.

The obtaining of a device in which the long axis of the feed dog elliptical path is parallel to the work surface is achieved with the device in question by causing the feed dog support bars to perform the elliptical movement with the aid of two mechanisms, one for advancing and the other for raising. The raising mechanism is composed of a support making a vertical reciprocaing movement, and this support is provided with a horizontal guide along which the feed dog support bar or bars is or are moved reciprocatingly by the advancing mechanism.

BRIEF DESCRIPTION OF THE DRAWING

Other objects and advantages of this invention will be part obvious and in part explained by reference to the accompanying specification and drawing, in which:

The FIGURE shows a perspective view of a feed dog drive arrangement constructed in accordance with this invention.

By way of example, the description relates to a sewing machine having two feed dog support bars 1 and 2 for the front or differential dogs 3 and the rear or main dogs 4, these bars being mounted for horizontal sliding in the slot 5 serving as horizontal guide and formed in the support 6, which is vertically movable because it is pivoted by means of pins 7 and 8 on a double pair of connecting rods 9 and 10, which are parallel to one another and vertically spaced apart to form a parallelogram; these connecting rods are in turn pivoted by means of pins 11 and 12 on the frame or on an adjustable part 13 joined to the frame.

The slot or guide 5 has a U-shaped vertical section closed at the tope by the plate 14 fixed on the support 6 by means of screws 15.

The vertical movement imparted to the support bars 1 and 2 is a reciprocating movement and is produced by an eccentric kinematic system adjustable for the purpose of selecting the length of the stitch. This kinematic system is composed essentially of the adjustable eccentric 16 mounted on the rotating shaft 17 and connecting rod 18 to an oscillating arm 19 fixed on the oscillating feed shaft 20.

The movement imparted to the support 6 is of the reciprocating type and is generated by an eccentric 28 of fixed eccentricity, which is mounted in a slidable member 29 inserted between the prongs 30 and 31 of the support 6 in order to bring about the displacement of the dogs from the sliding plane of the work (not shown in the drawing), whenever these dogs are moved in one direction, and then the lowering of the dogs below that plane when the dogs are moved in the opposite direction, for the purpose of feeding the fabric in one direction in synchronism with the sewing needle (not shown in the drawing).

On the feed shaft 20 is also keyed a sleeve 21 carrying two oscillating arms 22 and 23. The oscillating arm 22 is provided with a slot 24 in which a connector 25 to which a connecting rod 26 connected to the support bar 1 is pivoted, can be positioned at various distances from the feed shaft 20. The other oscillating arm 23 is connected by a connecting rod 27 to the other support bar 2. The different types of connection of the two connecting rods 26 and 27 to the respective oscillating arms 22 and 23 make it possible to effect simultaneous displacement of the two feed dogs 3 and 4, but with differentiation of the distance of their displacement.

The combination of the movements of the bars 1 and 2 of the support 6 is such that the dogs 3 and 4 describe, in the vertical plane, a perfectly regular elliptical trajectory, moving in space always parallel to themselves.

The adjustable part 13 is fixed on a pin 32 in such a manner that the vertical position of the support 6 depends on its positioning, and thus it is possible to obtain the elliptical trajectory travelled over by the dogs 3 and 4 with the major axis lying perfectly parallel to the sliding plane of the work.

While the invention has been described with reference to a specific embodiment, neither the illustrated embodiment nor the terminology employed in describing it is intended to be limiting; rather, it is intended to be limited only by the scope of the appended claims.

We claim:

1. In a sewing machine having a frame, feed dogs for moving work through the stitching zone and an oscillating feed shaft for driving the feed dogs, an improved support causing the dogs to move in an elliptical path the long axis of which is parallel to the plane of the work, said support comprising:

(a) feed dog support bars connected at one end to the feed dogs and at the other end operably connected to the oscillating feed shaft for effecting rectilinear movement of the feed dogs;

(b) support means for holding said feed dog support bars in their operative position;

(c) means operatively connecting said support means to the machine frame for vertical movement; and (d) vertical drive means operatively connected between said support means and the oscillating feed shaft to effect vertical movement of said support means and thereby cause said feed dog support bars and the feed dogs to move in an elliptical path.

2. An improved support as defined in claim 1 wherein said means operatively connecting said support means means to the machine frame comprises a pair of parallel support arms operatively hinged at one end to the frame and at the other end to said support means.

3. An improved support as defined in claim 1 wherein said vertical drive means comprises cam means in operative contact with said support means.

4. An improved support as defined in claim 1 wherein said support means includes a slot in the upper end thereof to receive said feed dog support bars.

5. An improved support as defined in claim 2 wherein one end of said parallel support arms are connected to an adjustable support bracket that is mounted on the machine frame.

6. An improved support as defined in claim 1 wherein means is provided in the oscillating feed shaft for adjusting the distance of travel of one of the feed dogs.

* * * * *